United States Patent [19]

Jacobsson

[11] Patent Number: 4,531,385

[45] Date of Patent: Jul. 30, 1985

[54] METHOD FOR FEEDING YARNS OF DIFFERENT COLORS TO A KNITTING MACHINE AND KNITTING MACHINE FOR CARRYING OUT THAT METHOD

[75] Inventor: Kurt A. G. Jacobsson, Ulricehamn, Sweden

[73] Assignee: Aktiebolaget IRO, Ulricehamn, Sweden

[21] Appl. No.: 420,224

[22] PCT Filed: Apr. 16, 1982

[86] PCT No.: PCT/EP82/00083

§ 371 Date: Sep. 7, 1982

§ 102(e) Date: Sep. 7, 1982

[87] PCT Pub. No.: WO82/03642

PCT Pub. Date: Oct. 28, 1982

[30] Foreign Application Priority Data

Apr. 16, 1981 [SE] Sweden ..... 8102464

[51] Int. Cl.[3] ..... D04B 15/48; D04B 15/60; D04B 15/62

[52] U.S. Cl. ..... 66/132 T; 66/140 R; 66/144; 242/47.01

[58] Field of Search ..... 66/125 R, 132 T, 144, 66/140 R; 242/47.01

[56] References Cited

U.S. PATENT DOCUMENTS

| | | | |
|---|---|---|---|
| 1,726,396 | 8/1929 | Larkin | 66/144 X |
| 2,232,616 | 2/1941 | Larkin | 66/144 |
| 4,116,393 | 9/1978 | Inouye et al. | 242/47.01 X |
| 4,199,965 | 4/1980 | Wilson | 66/125 R |
| 4,298,172 | 11/1981 | Hellstrom | 242/47.01 |

FOREIGN PATENT DOCUMENTS

| | | | |
|---|---|---|---|
| 1191486 | 5/1970 | United Kingdom | 66/125 R |

*Primary Examiner*—Wm. Carter Reynolds

*Attorney, Agent, or Firm*—Flynn, Thiel, Boutell & Tanis

[57] ABSTRACT

The invention relates to a method for feeding yarns of different colors to a conventional knitting machine for producing striped fabrics (circle-striped fabrics). The first step of the method according to the invention consists in selecting and presenting a predetermined length of a yarn of a desired color in accordance with the striped pattern to be produced. The so selected and presented yarn lengths are subsequently joined to form a continuous yarn. In a third step, the continuous yarn formed of said joined yarn lengths is intermittently formed into an intermediate store, from which the yarn is positively fed to the knitting machine at a constant speed in synchronism with the operating speed of the knitting machine. In this fourth step of the method, the continuous yarn is fed to the associated knitting system of the machine. Joining of the individual yarn lengths to form the continuous yarn is carried out in synchronism with the operating cycles of the knitting machine, so that the intermediate yarn store is formed at a rate corresponding to the yarn consumption of the knitting machine for each revolution thereof. This permits the splices between the individual yarn lengths to be positioned with high accuracy at the same location of the needle bed during each revolution of the machine. The invention is also directed towards apparatus for carrying out the method (FIG. 1).

10 Claims, 9 Drawing Figures

METHOD FOR FEEDING YARNS OF DIFFERENT COLORS TO A KNITTING MACHINE AND KNITTING MACHINE FOR CARRYING OUT THAT METHOD

FIELD OF THE INVENTION

The invention relates to a method for feeding yarns of different colours from yarn supplies through a positive feeding device and a yarn selection unit to a knitting machine for producing striped fabrics.

BACKGROUND OF THE INVENTION

It is known to place the positive feeding devices between the yarn supply packages and the yarn selection unit. The latter unit is directly associated with the knitting machine, which is thus equipped with a number of yarn selection units corresponding to the number of knitting systems. A separate positive yarn feeding element is required for each yarn. This makes the knitting machine and its feeding system complicated. A major problem of these knitting machines specifically designed for the production of striped fabrics is that bulky equipment must be installed immediately adjacent the knitting system, thus making the machine difficult to assemble, to repair and to adjust.

The technical problem underlying this invention is to devise a method of the above-outlined type which permits of feeding of yarns of different colours to a conventional knitting machine, thus enabling a simple knitting machine to produce striped fabrics.

This problem is solved by the invention in that for feeding the yarns to a conventional knitting machine having no selection units immediately associated with its knitting systems, an unbroken yarn consisting of portions of different colours is formed for and fed into each knitting system of the machine by the following steps:

(a) in a separate selection unit controlled in synchronism with the working cycle of the machine and in dependence on the desired striping pattern a yarn of the desired colour is selected, (b) the selected yarn is connected at a joining station to the unbroken yarn travelling into the knitting machine, (c) an intermittent buffer store is formed of the unbroken yarn downstream of the selection unit, and (d) the unbroken yarn is positively fed from the buffer store to the knitting system, the lengths of unbroken yarn being controlled in accordance with the desired striping pattern.

By use of the method according to the invention it is possible to produce striped fabrics on a conventional knitting machine with relatively simple additional equipment, which can be located at a certain distance above or outside of the knitting machine itself. The feeding system is also simpler than in known cases, because only one unbroken yarn has to be fed to each knitting system.

The control of the length of unbroken yarns running into each knitting system preferably starts at the joining station. This enables the control to place the joints of the yarn ends, which are normally knots, at a specific location in the fabric where they do not disturb the overall appearance, e.g. at the location where the fabric is later severed.

The invention also relates to a knitting machine for producing striped fabrics from yarns of different colours stored in yarn supplies, selected by a selection unit and fed to the knitting systems of the machine by a positive feeding device.

As outlined above, known knitting machines of this type are specifically designed for the production of striped fabrics and are rather complicated and bulky.

The invention provides a simpler production unit for striped fabrics and is characterised in that the knitting machine is a conventional knitting machine having no selection units immediately associated with its knitting systems, that a yarn selection unit controlled in synchronism with the working cycle of the knitting machine and in dependence on the desired striping pattern is provided separate from each knitting system, that a yarn knotting, clamping and cutting device is associated with each yarn selection unit, that an intermediate yarn storage device is provided downstream of the knotting, clamping and cutting device, and that a positive yarn feeding device is provided downstream of the intermediate yarn storage device.

Preferably, the intermediate yarn storage device consists of a stationary drum and a winding-on element provided with a winding drive. In this way, the additional twist on the unbroken yarn is kept at a minimum. It would, however, also be possible to use a rotating intermediate storage drum.

Preferably, the positive yarn feeding device is a tape feeder. Such a tape feeder can feed all the unbroken yarns to the knitting system of the machine and is of simple and rugged structure.

A further task underlying the invention is to provide a simple and yet efficient control for the feeding of the unbroken yarns to the knitting systems in such a way that the desired striping pattern is exactly produced.

To this end the invention provides a control system consisting of a patterning unit controlling the selection unit and a secondary control unit controlling the knotting, clamping and cutting device and the drive for the winding-on element, said secondary control unit being associated with first and second sensors sensing the yarn lengths consumed by the knitting machine and fed into the intermediate yarn storage device and supplying the secondary control unit with such yarn length information.

Since the secondary control unit always contains information on the length of yarn present in the intermediate storage device and on its way from said storage device to the knitting system, and since the secondary control unit controls the knotting, clamping and cutting device, the lengths of the differently coloured yarn portions can very exactly be determined and controlled so that a regular striping pattern develops.

Preferably, the secondary control unit controls the knotting, clamping and cutting unit and the drive for the winding-on element in such a way that the drive is inactive when the knotting takes place. This greatly facilitates the joining together of the yarn ends in the knotting device.

In the preferred embodiment of the knitting machine according to the invention a third sensor is associated with the secondary control unit sensing the working position of the knitting machine and supplying the secondary control unit with such machine position information.

This additional information enables the control system to provide for a continuous correction of the yarn joining operation and of the length measurement of the yarn to exactly position the knots in the fabric and to compensate for imperfections in the drive system of the knitting machine.

An embodiment of the invention is disclosed schematically in the attached drawings and will be described hereinafter:

DETAILED DESCRIPTION

Figure 1:
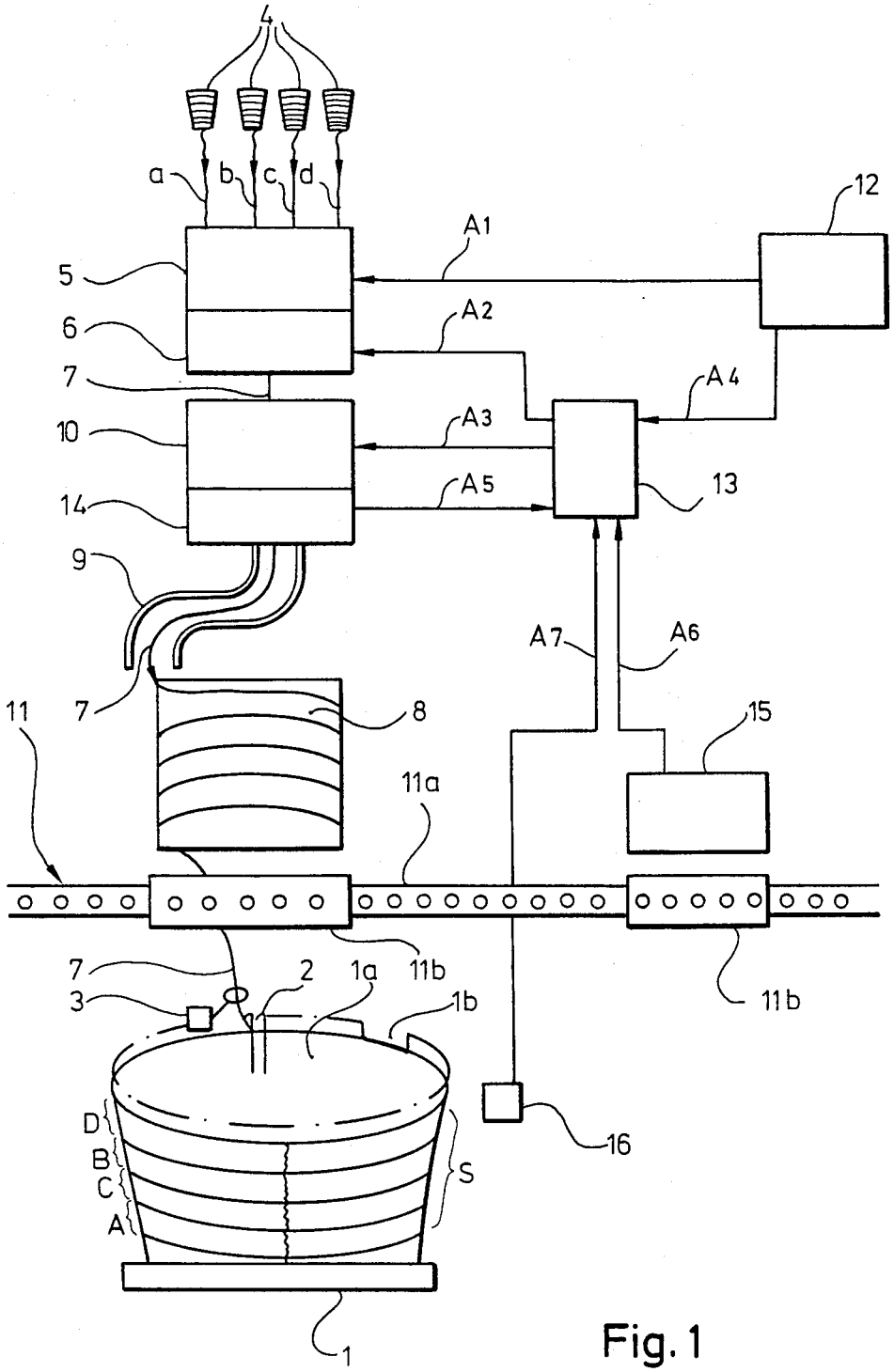
FIG. 1 schematically illustrates an embodiment of the invention.

In the drawings, 1 designates a conventional knitting machine with a rotating needle cyclinder 1*a* along the circumference of which needles 2 are mounted in grooves and displaceable in longitudinal direction. 3 is a knitting system which places the yarn into and out of a position in which it can be gripped by the needles 2. Several of these knitting systems are located around the circumference of the needle cylinder in stationary positions. In the embodiment shown, the needle cyclinder 1*a* has a sector 1*b* which is free of needles.

The knitting machine 1 is of conventional design and, therefore, need not be described in more detail. AS opposed to conventional practice, in accordance with the invention the needle machine 1 is to produce striped fabric as indicated at S. The fabric S consists of stripes of different colours A–D following each other in a predetermined sequence.

For making these stripes, yarns of the respective colours a–d are provided in the form of yarn packages or coils 4 mounted in conventional manner on a mounting ring of the knitting machine or on a separate spool rack. A yarn selection unit 5, for example of the type that is conventionally used in known horizontal striping machines in direct association with the knitting systems, is provided to sequentially select the proper yarn. The yarn selection unit alternately selects one of the, for example four yards a–d of different colours in generally the same way as the yarn selection takes place in known horizontal striping knitting machines closely upstream of the knitting place.

A knotting, cutting and clamping device 6 is directly joined to the selection unit 5. This can be a conventional yarn knotting device which knots an incoming yarn selected by the selection unit 5 to an outgoing unbroken yarn 7 and cuts and clamps the ends of the yarns respectively previously forming part of the unbroken yarn 7.

Downstream of the unit 5, 6, a stationary intermediate storage drum 8 is provided. The unbroken yarn 7 can be wound on that drum by a winding-on element 9 rotated by a drive 10, e.g. an electric motor. Storage systems of this kind are known in the art for intermittently feeding yarn to a knitting or weaving machine.

A positive feeding device 11 withdraws the yarn 7 from the storage drum 8 and feeds it to the knitting system 3 of the knitting machine 1. In the shown embodiment the positive feeding device 11 is a conventional tape feeder in which the yarn is clamped between a driven tape 11*a* and rotating clamping wheels 11*b* to provide a positive drive for each respective yarn. Such tape feeders are well known in the art for positively feeding yarn to knitting machines.

A control system is provided for the whole operation, which consists of a patterning unit 12 and a secondary control unit 13. The secondary control unit receives signals from a first sensor 14 associated with the winding-on element 9, a second sensor 15 associated with the positive feeding device 11 and a third sensor 16 associated with the cylinder 1*a* of the knitting machine 1.

The control is carried out in the following manner:

The patterning unit 12 is synchronized with the operation of the knitting machine 1 and sends control pulses to the yarn selection unit 5 in accordance with a patterning programme stored in the unit 12 as indicated by the arrow $A_1$. In accordance with the $A_1$-signals the yarn selection unit 5 selects one of the four yarns a–d. Thus the patterning unit 12 decides the width of the stripes A–D in the fabric S, or, in other words how many courses each stripe comprises.

The secondary control unit 13 determines the exact point in time at which the newly selected yarn a resp. b resp. c resp. d is joined by the device 6 to the unbroken outgoing yarn 7. This control signal is indicated by the arrow $A_2$. At the same time, the secondary control unit 13 emits a signal as symbolised by the arrow $A_3$ to the drive 10 for the winding-on element 9 and de-activates that drive so that the knotting can take place during a period of time when the unbroken yarn 7 does not move in the device 6. Of course, the signal $A_3$ slightly precedes the signal $A_2$ because some time is necessary to stop the drive 10. The drive 10 is preferably a stepping motor which can be stopped at an exact angular location and rapidly accelerates.

The secondary control unit 13 must receive patterning information from the unit 12, as indicated by the arrow $A_4$. Thus, the unit 12 basically determines when a colour change takes place and the secondary control unit 13 defines the exact point in time when this change takes place.

The function of the secondary control unit 13 is to provide exact lengths of the yarns of different colours in the unbroken yarn 7 so that the latter results in an exact striping pattern in the fabric S. For that purpose, the sensor 14 provides information on the exact position of the winding-on element 9 to the secondary control unit 13, as indicated by the arrow $A_5$. The sensor 14 can be of a type emitting pulses corresponding to the revolutions of the winding-on element 9.

Furthermore, the secondary control unit 13 receives information from the sensor 15 corresponding to the travelling speed of the tape 11, as indicated by the arrow $A_6$. The sensor 15 can be of the optical type, responding to optical signals developed by reflectors on the tape 11*a* or on the drums 11*b*.

The information provided to the unit 13 by signals $A_5$ corresponds to the length of yarn wound on the storage drum 8. The information supplied by the sensor 15 via $A_6$ corresponds to the length of yarn 7 withdrawn from the storage drum by the positive feeding device 11. The length of yarn between the winding-on element 9 and the knotting point in device 6 is constant. Since the secondary control unit 13 generates the knotting signal $A_2$, the unit 13 always contains information as to the length of yarn present between the knotting point and the knitting machine. This enables the unit 13 to develop the knotting signal $A_2$ always at a point in time which corresponds to the exact length of yarn of a specific colour required for the pattern to be produced.

In addition, the secondary control unit 13 continuously controls the speed of the drive 10 through $A_3$ to adjust that speed to the yarn consumption as sensed at 15. In this way, the intermediate yarn store on drum 8 can be maintained within narrow limits and the speed changes in the winding-on system can be kept at a minimum.

The described control system makes it possible to place the knots in the unbroken yarn 7 always into the gap 1*b* on the needle cylinder. The fabric is later cut along the area in which it spans the gap, so that the knots are present in an uncritical area of the fabric.

The sensor 16, which can be also of the optical type and co-operates with reflectors on the knitting machine cylinder 1*a*, develops information as to the exact position of the needle cylinder. This information is fed into the secondary control unit 13, as indicated by arrow A7, and serves as correction information. In this way fault effects, for example due to imperfections in the drive system of the knitting machine, which would cause a displacement of the knots into areas where they are not desired, can be eliminated.

The described system makes it possible to produce a striped fabric on any plain knitting machine with high fabric quality and exact striping pattern. In addition, the density and the quality of the striped fabric can be varied by simply changing the speed of the positive feeding device 11. No other adjustments are necessary.

All the units and devices 5, 6, 10, 9, 8 and 11, can be located at a distance above or outside of the knitting machine 1, so that they are easily accessible for adjustment and repair work.

Shown diagrammatically in FIGS. 2 to 8 is one form of construction and operation of knotting station 6 indicated in FIG. 1 and comprising a yarn splicing, clamping and cutting apparatus. However, the knotting station 6 can assume many conventional forms, one example of which is illustrated by U.S. Pat. No. 1,726,396.

Figure 2:
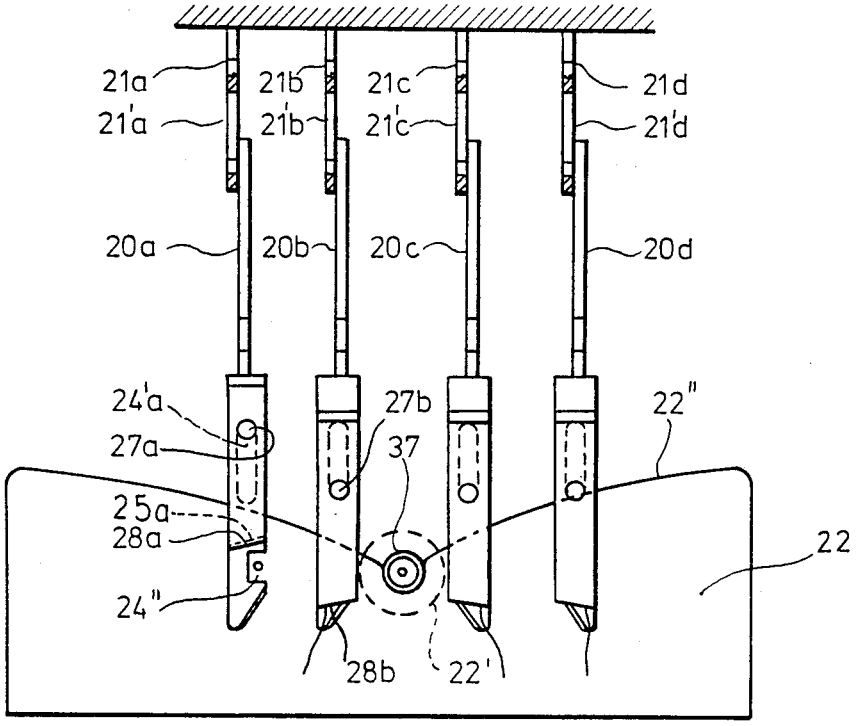
FIG. 2 schematically illustrates a part of a yarn knotting device, specifically a device for handling four yarns.

FIG. 2 shows four identical yarn clamping and cutting devices 20*a*, 20*b*, 20*c*, and 20*d* carried by stationary mounting plates 21*a*, 21*b*, 21*c*, and 21*d*, respectively, for selective linear and pivotal movement. As will be explained in detail below, these devices are adapted to be operated for presenting the respective yarns a, b, c, and d, respectively, supplied from the respective yarn spools 4*a*, 4*b*, 4*c*, and 4*d*, respectively, to a knotting or splicing station 22' of a knotting or splicing apparatus 22 of known construction. Splicing of the yarns may for instance be carried out by the splicing apparatus by an electrostatic process.

As shown more clearly in FIGS. 3 to 8, each yarn clamping and cutting device 20, in this case 20*b*, is guided in a slot 21' of a stationary plate 21 for pivotal and linear movement against the bias of a spring 23. A head portion 20' of yarn clamping and cutting device 20 comprises a central plate 24 formed with a longitudinally extending slot 24' (FIG. 2). Further plates 25 and 26 located on opposite sides of central plate 24 are connected to one another by a connecting bolt 27 extending through slot 24'. Plate 25 is formed as a yarn cutting blade. Both plates 25 and 26 are formed with stop surfaces 25' and 26', respectively. Attached to plates 25 and 26 by means of connecting bolt 27 is an arcuate yarn clamping blade 28. Slot 24' permits plates 25 and 26 as well as blade 28 to be shifted relative to central plate 24. This shifting capability is made use of for controlling the yarn clamping and cutting operations at the respective proper timings by cooperation of stop surfaces 25' and 26' with first and second stationary stops 29 and 30, respectively.

Yarn clamping and cutting device 20 is adapted to be pivoted by energizing a linear solenoid 31 engaging a surface 20'' of device 20. Energization of a rotary solenoid (not shown) causes a control plate 32 to be rotated, whereby device 20 is rotated by the cooperation of a first control pin 33 of plate 32 with a control slot 34 of device 20. Additional movement of control plate 32 results in relative movement between a second control pin 35 of plate 32 and a control surface 36 of device 20.

The operation of the yarn clamping and cutting device shall now be described with reference to FIGS. 3 to 8 under the assumption that a length of a yarn "b" is to be selected for connection to a preceding yarn "a" for forming a continuous yarn to be fed to the knitting machine.

Figure 3:
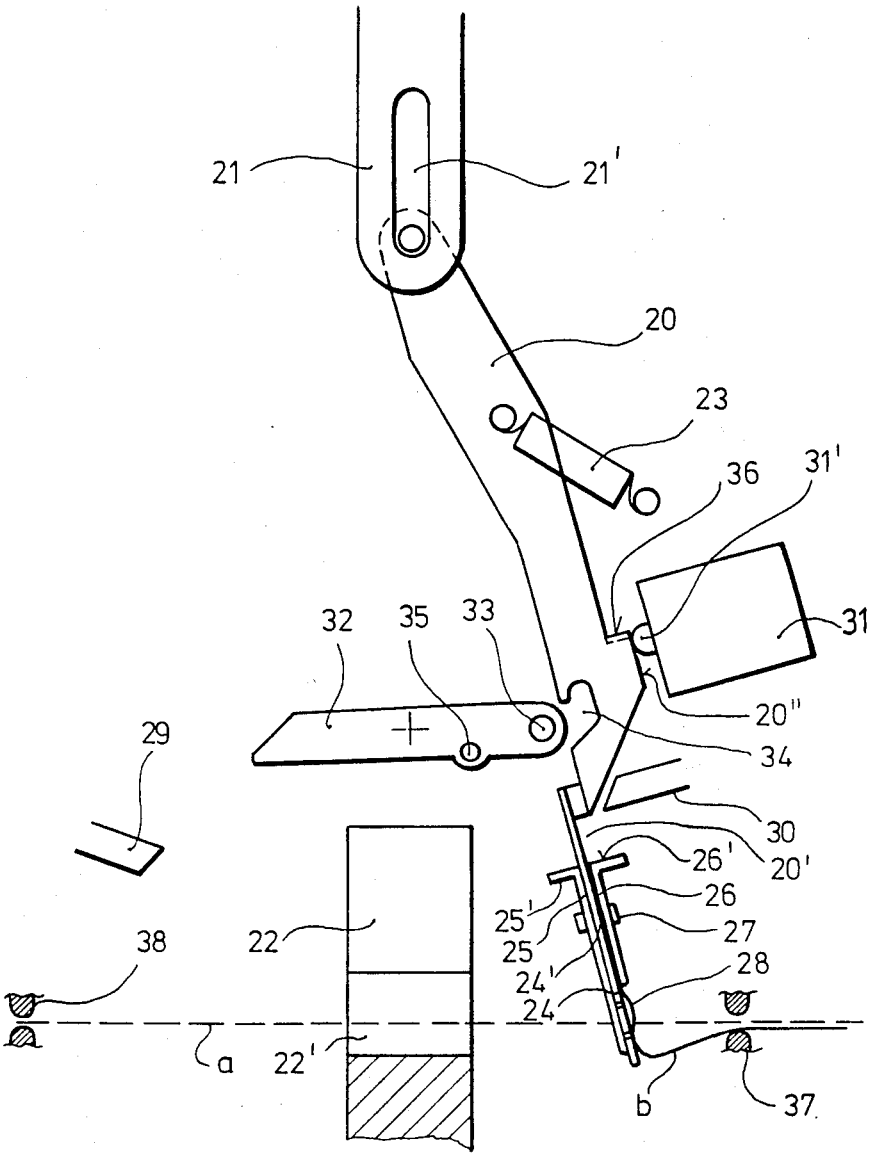
FIGS. 3–8 are schematic elevational views illustrating the operation of the yarn knotting device.
Figure 4:
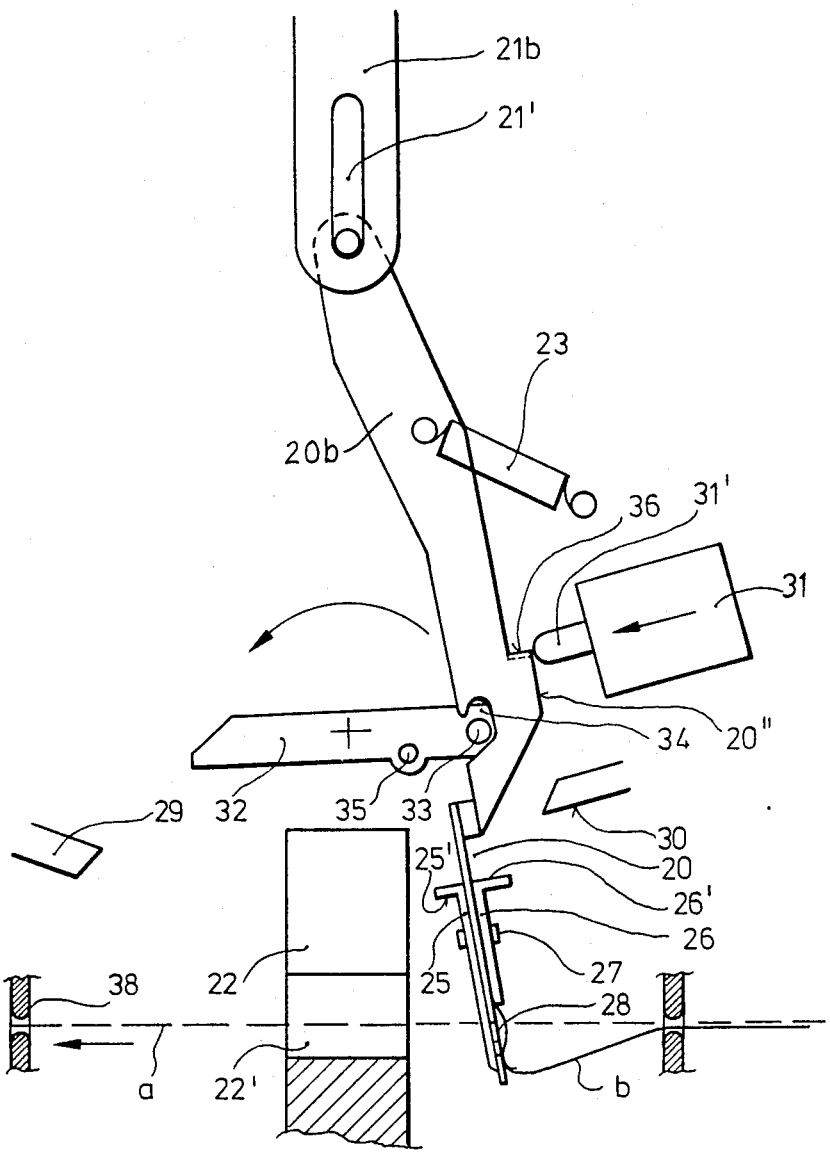
Figure 5:
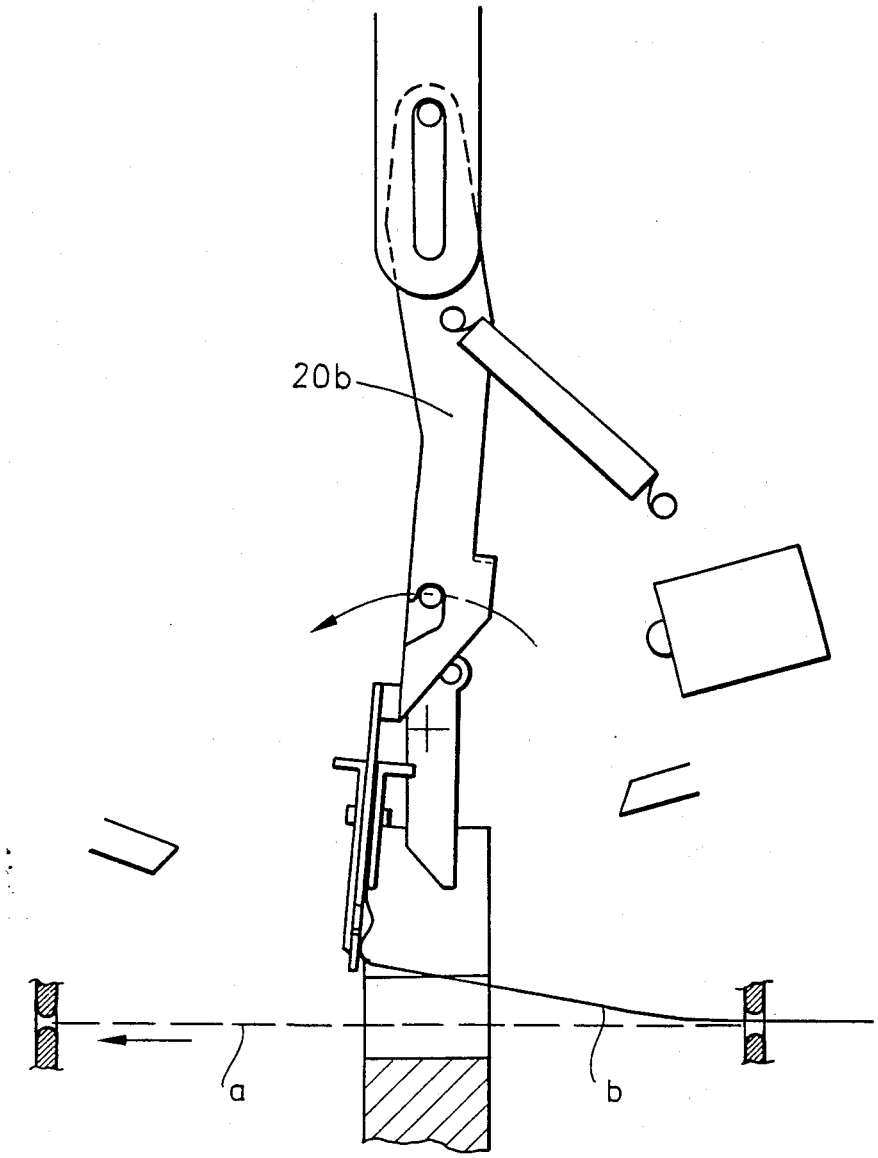
Figure 6:
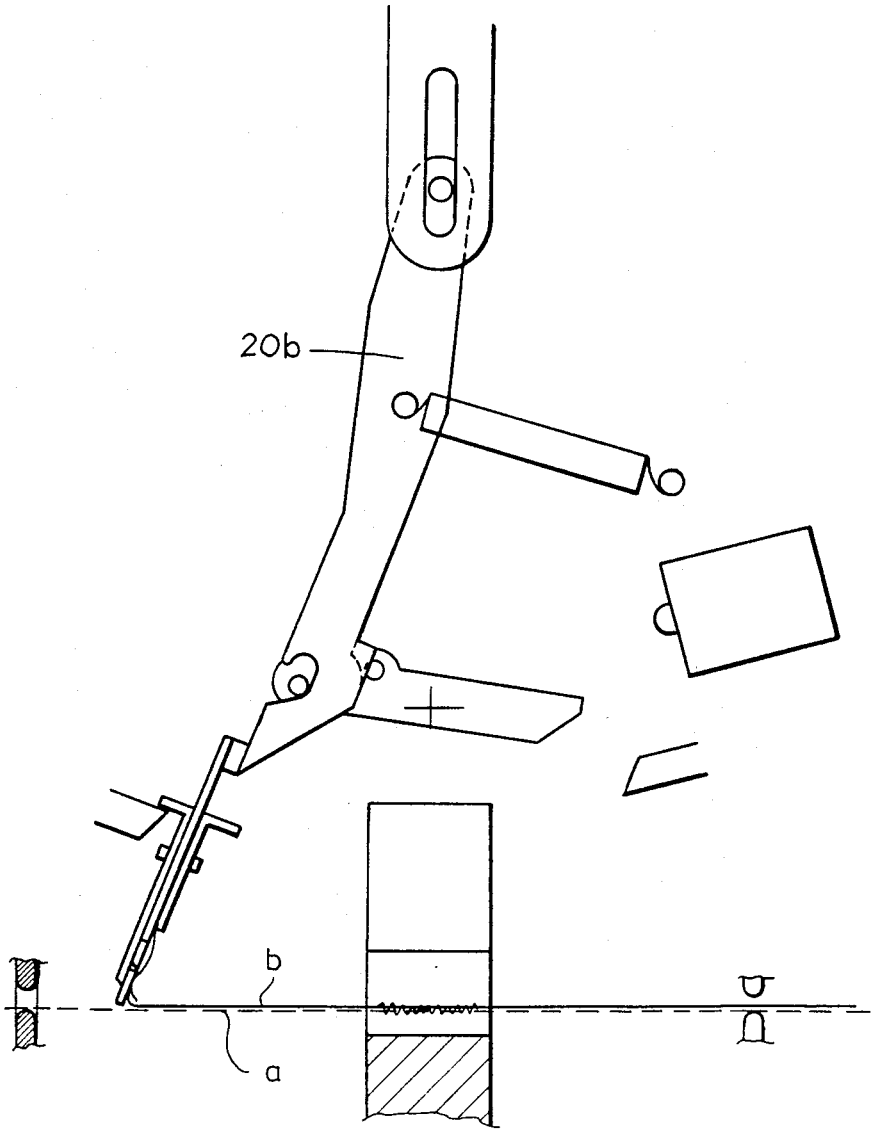

In FIG. 3 yarn "a" provided from yarn spool 4*a* is shown to extend through stationary guide eyelets 37 and 38 located upstream and downstream, respectively, of knotting or splicing station 22' of apparatus 22. At a predetermined time, pattern control unit 12 (FIG. 1) supplies on energizing pulse to linear solenoid 31, so that the plunger 31' thereof exerts a pressure on control surface 20'', as shown in FIG. 4. This causes device 20*b* to be moved to the left in FIG. 4, so that control slot 34 comes into engagement with first control pin 33. Immediately thereafter, second control unit 13 (FIG. 1) supplies an energizing pulse to the (not shown) rotary solenoid, causing control plate 32 to be rotated counterclockwise (FIG. 5), whereby yarn clamping and cutting device 20*b* is rotated to its limit position shown in FIG. 6. Due to a suitable configuration of a surface 22'' of the yarn knotting or splicing apparatus 22, this movement of device 20*b* results in yarn "b" being guided transversely towards yarn "a" extending through knotting or splicing station 22', so that yarn "b" extends closely adjacent to yarn "a" and parallel thereto.

At this instant, second control unit 13 supplies "a" stop pulse to drive unit 10, so that winding of yarn "a" is interrupted and yarn "a" comes to a standstill within knotting or splicing apparatus 22 for a short instant. Subsequently second control unit 13 supplies a start pulse to apparatus 22, resulting in the now stationary yarns "a" and "b" being joined by knotting or splicing at station 22'.

Figure 7A:
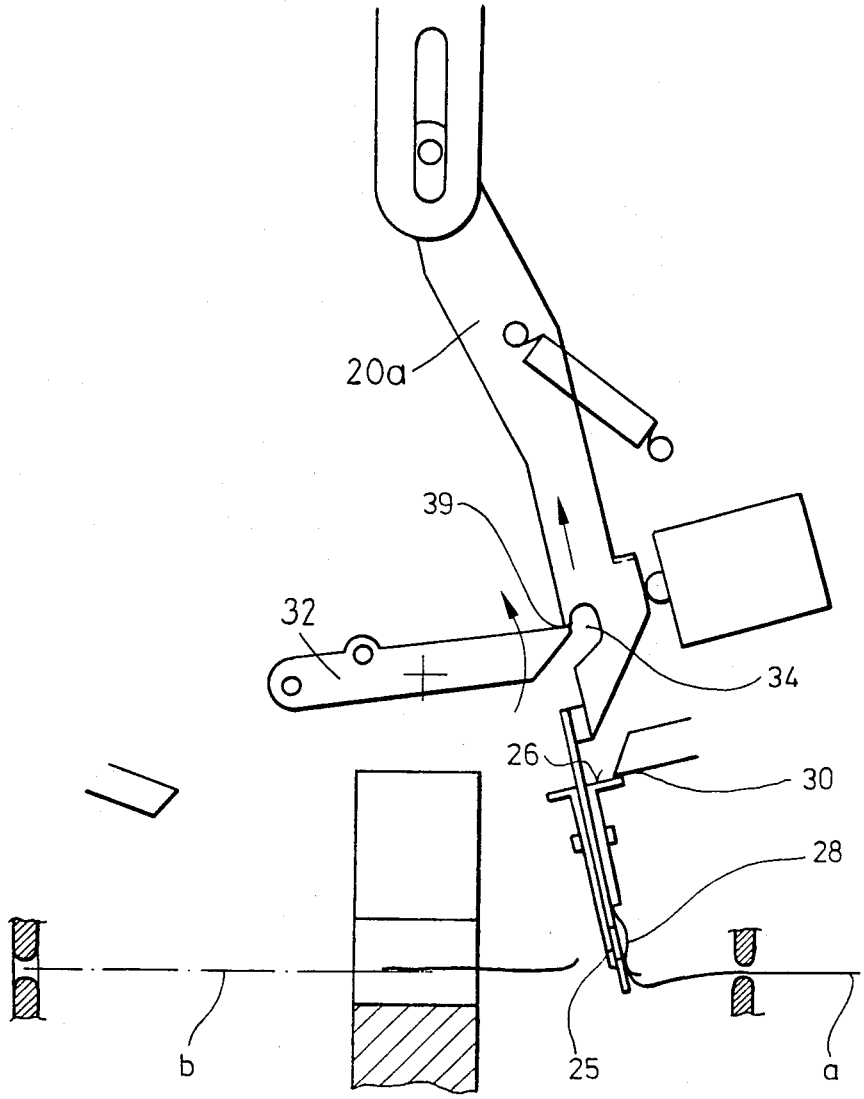
Figure 7B:
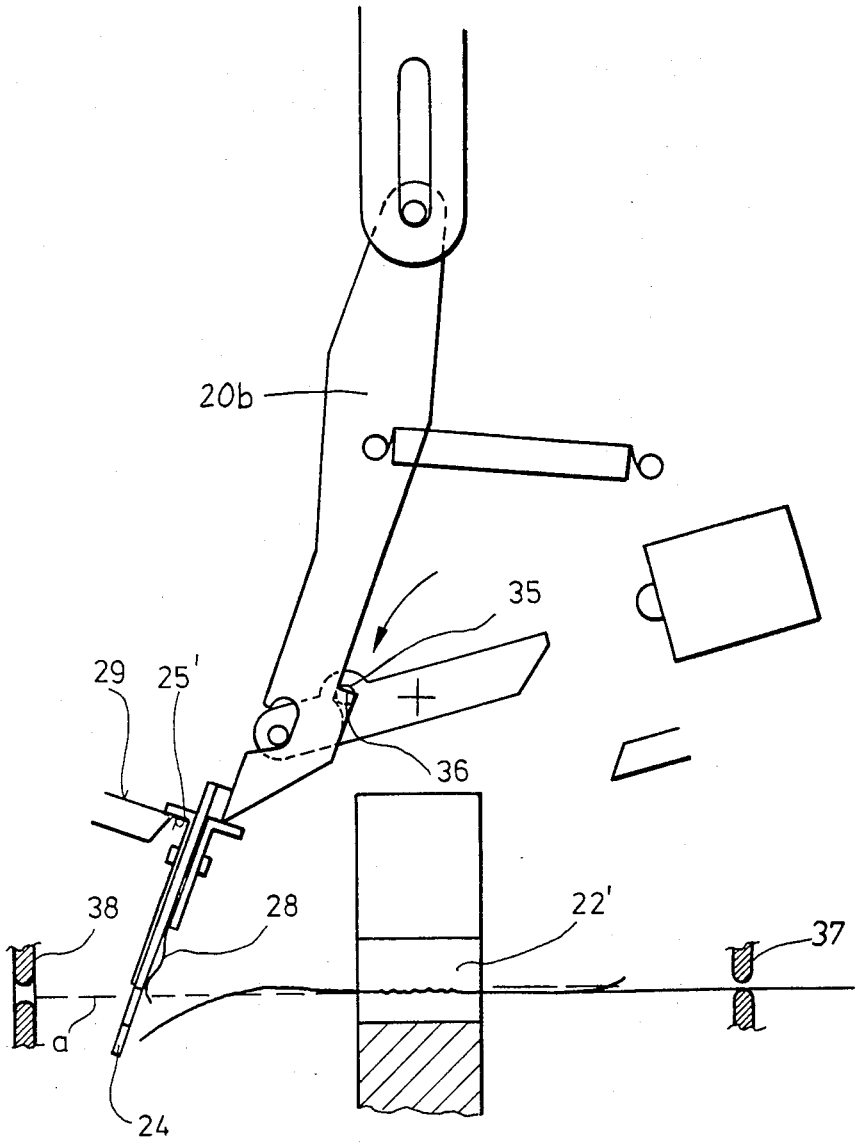

As soon as this step is finished, which is accomplished in a short instant of time, device 20*b* is moved further downward by engagement of second control pin 35 with control surface 36 into the position shown in FIG. 7*b*. Since in this position stop surface 25' is in engagement with first stationary stop 29, downward movement of device 20 causes central plate 24 to be shifted relative to clamping blade 28, whereby the hitherto clamped end of yarn b is released.

At the instant at which yarn b is released, yarn clamping and cutting device 20*a* for yarn a is in the position shown in FIG. 7*a* due to prior counterclockwise rotation of plate 32, whereupon line 20*a* is shifted upwards by engagement of a control edge 39 with control plate 32. In this position stop surface 26' is in engagement with second stationary stop 30, whereby upward movement of device 20*a* results in central plate 24 being shifted relative to cutting blade 25 and clamping blade 28, so that the yarn end "a" extending towards the knotting or splicing point is cut, while the yarn end extending in the opposite direction is clamped and retained. As a result, yarn a is now in a position corresponding to that of yarn b shown in FIG. 3, in preparation to being again selected.

Figure 8:
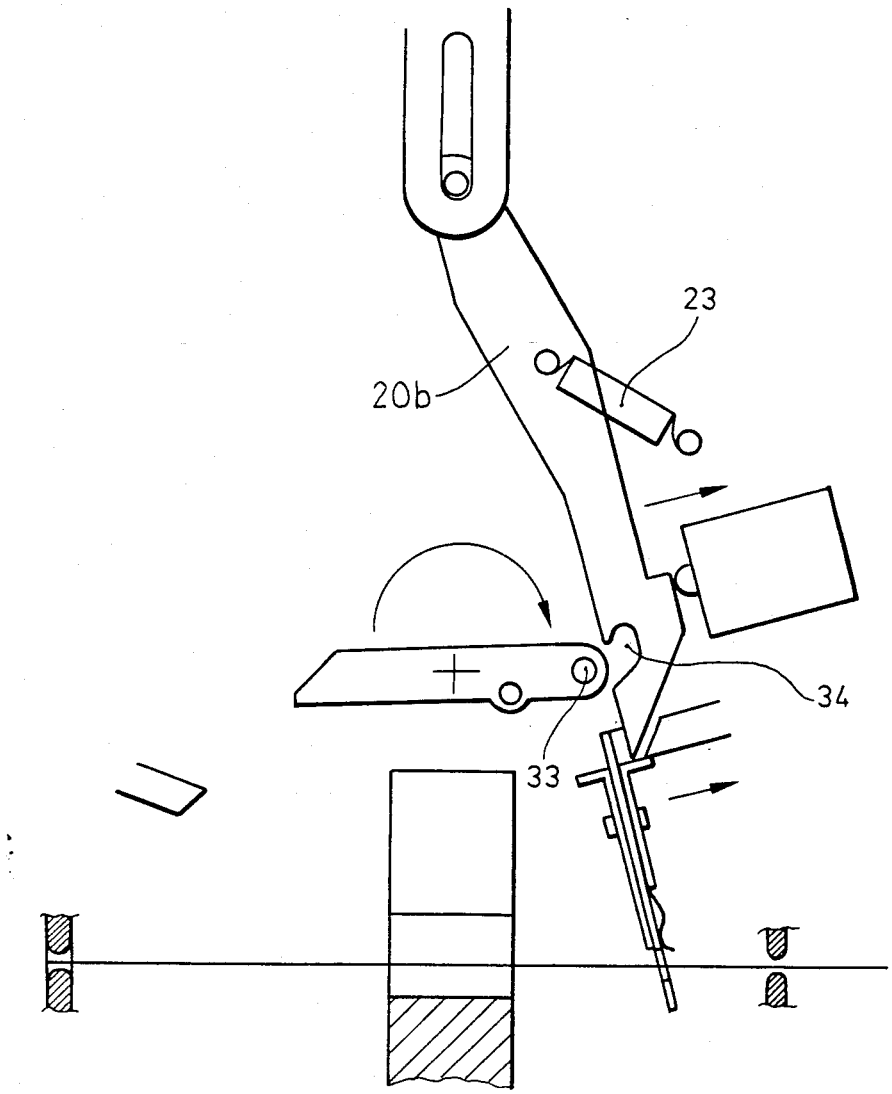

As the last step of the yarn selection and splicing operation, device 20*b* is returned to the position shown in FIG. 8 by energization of the rotary solenoid in the clockwise direction through engagement of first control pin 33 with control slot 34 and with the aid of spring 23. Due to the specific configuration of the guide slot 24″ of central plate 24, yarn b, which is now being continuously fed, moves into the hook-shaped slot 24″, whereby device 20*b* is able to cut and retain the yarn b when another yarn, for instance yarn c or d, is to be spliced with yarn b.

I claim:

1. In combination, a knitting machine for producing striped fabrics with yarns of different colors, a selection unit for selecting yarns from yarn supplies, a yarn knotting device arranged in cooperation with said selection unit for knotting yarn sections with lengths predetermined in dependence of the striping pattern of the knitting machine to form a continuous yarn, an intermediate yarn storage device for feeding said continuous yarn to a knitting system of the knitting machine, and a control unit provided with a patterning unit for controlling said selection unit, the improvement wherein the control unit contains a secondary control unit for receiving information representing (1) the fabric pattern, (2) the yarn length consumed by the knitting machine, (3) the yarn length stored in the intermediate yarn storage device and (4) the initial working position of the knitting machine, said secondary control unit including means for controlling the yarn knotting device and a drive of a storage forming element of the intermediate storage device.

2. A combination according to claim 1, wherein a positive yarn feeding device is provided in the running direction of the continuous yarn behind the intermediate yarn storage device.

3. A combination according to claim 1, wherein the drive of the storage forming element and a drive for the positive feeding device are provided with sensors for detecting yarn length, and the knitting machine is provided with a sensor connected with the secondary control unit for detecting the initial working position of the knitting machine.

4. A combination according to claim 1, wherein said intermediate yarn storage device is provided with a stationary drum and the storage forming element is a winding-up element arranged adjacent to the surface of the drum and rotatably driven by a motor.

5. A combination according to claim 1, wherein said drive for the storage forming element can be stopped by said secondary control unit.

6. A combination according to claim 1, wherein said positive feeding device is a tape-feeder.

7. In combination:

a knitting machine with a rotating needle cylinder provided with a plurality of needles movably mounted within grooves which extend longitudinally of the needle cylinder and are positioned circumferentially therearound, the needle cylinder having a sector which is free of needles;

a yarn feeding device for feeding a continuous yarn to the needles of the knitting machine;

an intermediate yarn storage device for storing thereon a quantity of said continuous yarn at a location disposed upstream of said yarn feeding device, said intermediate yarn storage device including a stationary drum; a rotatable storage forming element for winding said continuous yarn onto said drum to create the intermediate yarn storage thereon, and a drive for the rotatable storage forming element;

a yarn selection unit for selecting yarns from a plurality of yarn supplies of different colors;

a yarn knotting device arranged in cooperation with said yarn selection unit for knotting yarn sections with lengths predetermined in dependence on the striping pattern of the knitting machine to form said continuous yarn which is then fed to the storage forming element;

said yarn knotting device including (1) means for holding the free end of each remaining said yarn except for the continuous yarn which is supplied to the storage forming element, (2) means for knotting the free end of a selected one of said remaining yarns to the continuous yarn and (3) means for cutting the continuous yarn at a location upstream of the knot and holding the cut free end so that the selected one of said remaining yarns now comprises the continuous yarn;

a patterning unit for controlling the selection of the different colored yarns by the selection unit and for determining the striped pattern of the fabric produced on the knitting machine, the patterning unit sending control signals to the yarn selection unit for controlling the operation thereof in accordance with a patterning program stored in the patterning unit;

a control unit responsive to (1) the patterning program, (2) the position of the needle cylinder and (3) the yarn supplied to the needle cylinder for activating the yarn knotting device to cause one of the remaining yarns to be knotted to the continuous yarn when a color change is required, said control unit including means for transmitting a control pulse to the knotting device for activating same and to the drive of the intermediate yarn storage element for deactivating same so that the yarn color change can be effected.

8. A combination according to claim 7, wherein the control unit includes a first sensor cooperating with the needle cylinder for detecting the position thereof and for transmitting information to the control unit for determining the position of the needle cylinder, a second sensor associated with the yarn feeding system for transmitting information to the control unit which indicates the length of yarn withdrawn from the intermediate storage drum and supplied to the knitting machine, and a third sensor for supplying information to the control unit as to the length of yarn wound on the intermediate storage drum, said control unit also receiving pattern signals from the patterning unit in accordance with the patterning program stored therein.

9. A combination according to claim 8, wherein said control unit emits a first control signal to the yarn knotting device to activate the latter when a yarn color change is required, said control unit emitting a second signal to the drive of the storage forming element for stopping said drive when a yarn color change is to be effected, said control unit activating the yarn knotting device and stopping the drive in response to the information received from the sensors coupled with the pattern signals received from the patterning unit for causing the knots to be formed at a position such that the knots will ultimately be located in the needle-free sector of the needle cylinder.

10. A method for feeding yarns of different colors to a ring-type knitting machine for producing a striped fabric, comprising the steps of:

supplying a plurality of yarns of different colors from yarn supplies to a knotting unit;

selecting a single one of said yarns and feeding it as a continuous yarn from the knotting unit to the knitting systems of the knitting machine;

creating an intermediate yarn storage within the length of continuous yarn which extends from the knotting unit to the knitting machine by wrapping the continuous yarn around a stationary storage drum;

positively withdrawing the yarn from the storage drum by a positive feeding device to effect feeding of the yarn to the knitting systems of the knitting machine;

providing a patterning unit defining therein a program which determines the pattern of the striped fabric being knitted;

controlling a yarn selection unit as associated with said knotting unit by a pattern-selecting signal from said patterning unit for selecting which of said yarns is to be fed to said knitting machine;

providing a control unit which is responsive to a patterning signal from said patterning unit and is additionally responsive to further control signals for stopping the winding of said continuous yarn on said storage drum and activating said knotting unit to effect knotting of a newly selected yarn to the continuous previously selected yarn followed by cutting of the previously selected yarn upstream of the knot;

sensing the rotational position of the knitting machine and transmitting a control signal to said control unit;

sensing the quantity of the continuous yarn supplied to the knitting machine by the positive drive unit and transmitting a control signal to said control unit which is indicative as to the quantity of yarn supplied to the knitting machine;

sensing the quantity of yarn wound on said intermediate storage drum and transmitting a control signal to said control unit which is indicative of this quantity; and stopping the creation of said intermediate yarn storage and activating said knotting unit by said control unit in response to the control and patterning signals received thereby for effecting a color change and the creation of a knot between the two yarns of different colors at a location such that the resulting knot will ultimately be disposed in a needle-free sector of the knitting machine.

* * * * *

UNITED STATES PATENT AND TRADEMARK OFFICE

CERTIFICATE OF CORRECTION

PATENT NO. : 4 531 385

DATED : July 30, 1985

INVENTOR(S) : Kurt A. G. JACOBSSON

It is certified that error appears in the above-identified patent and that said Letters Patent is hereby corrected as shown below:

Column 7, line 37; change "claim 1" to ---claim 2---.

Column 7, line 52; change "claim 1" to ---claim 2---.

Signed and Sealed this

*Thirty-first* Day of *December 1985*

[SEAL]

*Attest:*

DONALD J. QUIGG

*Attesting Officer*

*Commissioner of Patents and Trademarks*